United States Patent [19]

Weiss

[11] 4,132,076

[45] Jan. 2, 1979

[54] FEEDBACK CONTROL METHOD FOR CONTROLLING THE STARTING OF A STEAM TURBINE PLANT

[75] Inventor: Gerhard Weiss, Oberrohrdorf, Switzerland

[73] Assignee: BBC Brown, Boveri & Company Limited, Baden, Switzerland

[21] Appl. No.: 708,038

[22] Filed: Jul. 23, 1976

[30] Foreign Application Priority Data

Aug. 22, 1975 [CH] Switzerland ..... 10897/75

[51] Int. Cl.[2] ..... F01K 13/92

[52] U.S. Cl. ..... 60/646; 60/657; 60/663; 290/40 A

[58] Field of Search ..... 60/646, 657, 658, 663, 60/679; 290/40 A, 40 B, 40 R, 52

[56] References Cited

U.S. PATENT DOCUMENTS

| | | | |
|---|---|---|---|
| 3,561,216 | 2/1971 | Moore, Jr. | 60/646 X |
| 3,813,884 | 6/1974 | Ishikawa | 60/679 X |
| 3,894,394 | 7/1975 | Braytenbah et al. | 60/663 X |

*Primary Examiner*—Allen M. Ostrager
*Assistant Examiner*—Stephen F. Husar
*Attorney, Agent, or Firm*—Burns, Doane, Swecker & Mathis

[57] ABSTRACT

The invention concerns a feedback control method for controlling the starting of a steam turbine unit comprising a reheater, a turbine by-pass system consisting of a HP-by-pass system and a LP-by-pass system, at least one regulating valve for the HP-by-pass system, at least one regulating valve for the LP-by-pass system, at least one inlet valve for the HP-turbine, at least one intercept valve for the MP/LP-turbine and a governing device to regulate the turbine speed or power output, according to which method during no-load and low-load operation and up to a predetermined partial load the pressure within the reheater is regulated by a first feedback control device with the LP-by-pass regulating valve acting as positioning element in such manner that a greater quantity of steam will flow through the HP-turbine than through the MP-turbine, and a smaller quantity of steam through the HP-by-pass system than through the LP-by-pass system, whereby a maximum permissible HP-exhaust steam temperature will not be exceeded, and when the partial load is greater than said predetermined value the pressure within the reheater is regulated by a second feedback control device with the intercept valves acting as positioning elements until the intercept valves are fully open, while the LP-by-pass regulating valve is closed during this part of the operation. The invention also concerns an apparatus for the practical application of the method.

28 Claims, 5 Drawing Figures

FEEDBACK CONTROL METHOD FOR CONTROLLING THE STARTING OF A STEAM TURBINE PLANT

The invention concerns a feedback control method for controlling the starting of a steam turbine plant having a reheater, a turbine by-pass system comprising a HP-by-pass system and a LP-by-pass system, at least one regulating valve for the HP-by-pass system, at least one regulating valve for the LP-by-pass system, at least one inlet valve for the HP-turbine, at least one intercept valve for the MP/LP-turbine and a governing device to regulate the turbine speed or power output. The invention also concerns an apparatus for the pratical application of this method.

For convenience, the following abbreviations will be used: HP (high pressure), MP (medium pressure), LP (low pressure) and RH (reheater).

In the case of a turbine unit of the type specified, live steam is piped directly into the RH through the HP-by-pass system, thus detouring the HP-turbine, and into the condenser through the LP-by-pass system, thus detouring the MP and LP turbine, an arrangement which makes it possible:

- to obtain the steam conditions required for the starting of the turbine;
- to conduct the steam through the by-pass system in case of load rejection or turbine trip, thus avoiding boiler trip;
- to accelerate or load the turbine at maximum gradients following a load rejection or a turbine trip, because the difference between steam temperature and turbine metal temperature will not go beyond an allowable value;
- to utilize — even during the by-pass operation — steam from the RH-system for a variety of accessory units; and
- to prevent, or at least reduce in frequency, the response of safety valves during load-rejections, and to insure a sufficient cooling of the reheater.

When such a steam plant is to be started, the turbine by-pass system is the first component to be placed in operation. If a certain quantity of steam is flowing through the by-pass system, and if pressure and temperature of the live steam as well as of the RH-steam have reached their specified values, one portion of the steam can be fed into the turbine for its starting process. During the start of the turbine there will arise difficulties during the initial period of no-load operation as well as low-load operation. The pressure within the reheater must be sufficiently high to operate at least the accessory units. This is accomplished by the well-known use of a minimum pressure controller which, during the by-pass operation, controls the LP-by-pass regulating valve, and also the intercept valves of the turbine no-load and low-load operation in such manner that the pressure within the reheater will build up correspondingly. If the turbine is placed in operation at this stage, the HP-turbine will act as backpressure turbine and the MP/LP-turbine as condensation turbine. It would be most desirable if the quantity of steam piped through the HP-turbine were greater than the quantity of steam piped through the MP/LP-turbine, since, as well known, a backpressure turbine consumes a greater amount of steam than a condensation turbine. However, in case of the nowadays frequently used control by means of two multiplier relays, described in the Swiss Pat. No. 369,141, the quantity of steam piped through the HP-turbine will always match the quantity of steam piped through the MP/LP-turbine, and the quantity of steam piped through the HP-by-pass system will be equal to the quantity of steam piped through the LP-by-pass system. Therefore, this known control will not meet the above mentioned requirement.

As a result thereof, the windage losses will rise to such magnitude that the HP-exhaust temperature can become very high, possibly even greater than the HP-admission temperature. The greater the rated power output of the turbine, the higher the HP-turbine exhaust temperature will become during no-load and low-load operation, due to these windage losses, with the result that a very pronounced heating of the HP-casing ensues. On the other hand, this exhaust temperature will drop very rapidly when the turbine load increases, because more steam will now flow through the HP-turbine. The steep negative temperature gradient $\Delta T/\Delta t$ (temperature difference per unit of time) resulting from this rapid drop in the HP-exhaust temperature causes a sudden cooling off of the HP-casing, and the high thermal stresses arising during this process can lead to permanent deformations within the HP-casing. For example, sealed areas can become leaky and steam can escape from the HP-turbine.

An object of the invention is to overcome the disadvantages of the known method for starting a turbine of the above-described type, and to establish a feedback control method which makes it feasible to keep the HP-exhaust temperature within allowable limits, thus avoiding excessive temperature variations within the HP-casing and eliminating unduly high thermal stresses resulting from such temperature variations.

The feedback control method which constitutes a solution of this problem is characterized by the features that during no-load and low-load operation, and up to a predetermined partial load, the pressure within the reheater is regulated by way of the LP-by-pass regulating valve acting as positioning element i.e., to conduct steam through the LP-by-pass in such manner that a greater quantity of steam will flow through the HP-turbine than through the MP-turbine, and a smaller quantity of steam through the HP-by-pass system than through the LP-by-pass system, whereby a maximum permissible HP-exhaust steam temperature will not be exceeded, and, when the partial load is greater than the predetermined value, the pressure within the heater is regulated by way of the intercept valves acting as positioning elements i.e., to conduct steam to the MP/LP turbine until the intercept valves are fully open, with the LP-by-pass regulating valve closed during this part of the operation.

An apparatus for the practical application of this method is characterized by a first feedback control device which is active during the no-load and low-load operation up to a predetermined partial load for the purpose of regulating the reheater pressure $p_{RH}$, with the LP-by-pass regulating valve acting as positioning element, and by a second feedback control device which is, generally independently, active in the case of a partial load greater than the predetermined value for the purpose of regulating said reheater pressure, with the intercept valves acting as positioning elements, the LP-by-pass regulating valve being closed during this stage.

A preferred species of the invention is designed to solve an additional problem which arises in case of a cold start in connection with the method of starting a steam turbine of the type in question as described by Swiss Pat. No. 369,141, if starting probes, disclosed in Austrian Pat. No. 197,839, are used for the measurement of thermal stresses of HP- and MP-rotors in combination with an automatic turbine control system. If the stress of the HP-rotor becomes greater than permissible, the gradient for the acceleration, or the loading of the turbine, will be reduced in proportion to the difference of real value minus desired value. If this method is used, the HP-rotor will determine the permissible gradient up to low-load operations, while the MP-rotor will determine this gradient at greater loads, the reason being that the saturated steam temperature corresponding to the steam pressure in front of the MP-turbine, will exceed the metal temperature only when the load reaches a certain magnitude since the MP-turbine is started against condenser pressure. Therefore, condensation cannot take place at the surface of the metal prior to this time; the transfer of heat will be poor, and the heating will be low. Furthermore, the MP-rotor has a greater diameter than the HP-rotor and therefore a greater mass, so that the starting period will be lengthened still further.

In order to avoid these disadvantages, the correcting signals supplied by the feedback control devices monitoring the thermal stresses of HP- and MP-rotor, which usually act directly upon the turbine governing device are separated so that both feedback control devices will exert their influence upon the turbine governing device if the HP-by-pass regulating valve is closed, but when said valve is open the HP-temperature probe signal will act upon the turbine governing device and the MP-temperature probe signal will act upon the second feedback control device, provided to control the RH-pressure with the intercept valves acting as positioning elements. This arrangement makes it possible to maintain the thermal stress of both rotors within permissible limits, and to accelerate and load both turbines independently of each other but also synchronously, an operation which can be accomplished under optimum conditions, that is at maximum thermal loading permissible for each turbine.

Species of the invention will now be explained herein below, with reference to the appended drawing, in which FIG. 1 shows a steam turbine with reheater and by-pass system, with a diagrammatically drawn feedback control apparatus for the starting control, with one species of the first feedback control device depicted in detail;

Figure 1:
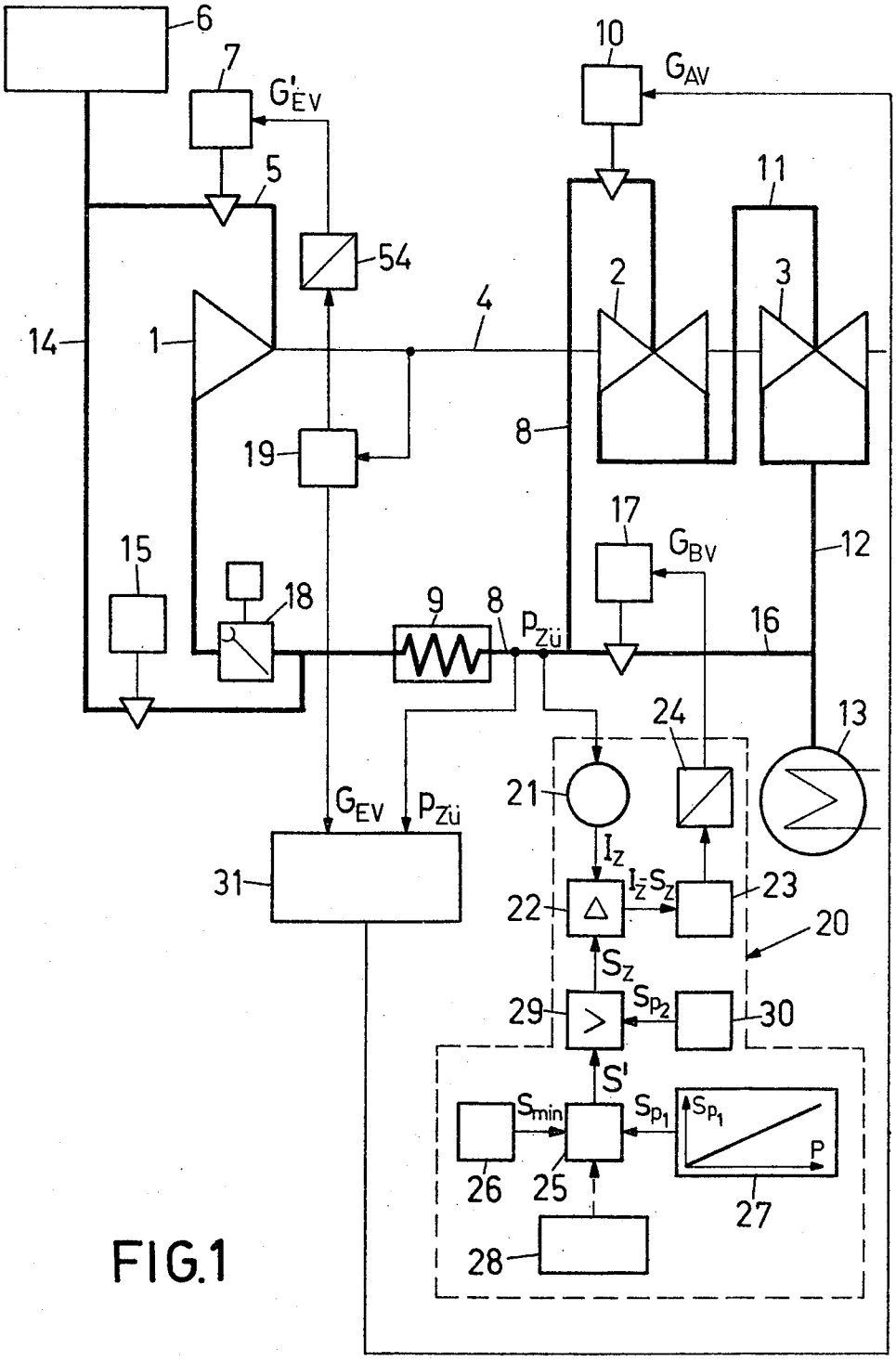

FIG. 1 shows a conventional turbine plant, its steam turbine comprising a HP-turbine 1, a MP-turbine 2 and a LP-turbine 3 and driving a generator (not illustrated) by means of shaft 4. A first steam conduit 5 leads from the steam generator 6 by way of the inlet valve 7 to the HP-turbine 1. A second conduit 8 leads from the HP-turbine 1 by way of the reheater 9 and the intercept valve 10 to the MP-turbine 2, and from there by way of conduit 11 to the LP-turbine 3. The exhaust steam from the LP-turbine 3 is then piped by way of the condenser neck 12 into the condenser 13. Live steam can also be detoured about the HP-turbine 1 and piped directly into the reheater 9 by way of the HP-by-pass conduit 14 and the HP-by-pass regulating valve 15. Steam can also be detoured about the MP/LP turbine into the condenser neck 12 and from there into the condenser 13 by way of MP/LP-by-pass conduit 16 and the LP-by-pass regulating valve 17. Within the conduit 8 there is shown a controlled check valve 18.

The feedback control apparatus comprises the turbine governing device 19, regulating the turbine speed or power output by way of the inlet valve 7, a first feedback control device 20, regulating the RH-pressure $p_{RH}$ in case of pure by-pass operation as well as in case of no-load and low-load operation by means of the LP-by-pass regulating valve 17 acting as positioning element i.e., to conduct steam through the LP-by-pass and a second feedback control device 31 which is substantially independent of the first feedback control device 20 and which regulates the RH-pressure $p_{RH}$ with the intercept valves 10 acting as positioning elements i.e., to conduct steam to the MP/LP turbine while the LP-by-pass regulating valve 17 is closed, until the intercept valves 10 are fully open; at this time the RH-pressure adjusts itself proportionally to the turbine load.

In order to regulate the RH-pressure $p_{RH}$ by means of the first feedback control device 20, the RH actual pressure value $I_Z$ is measured by a pressure transmitter functioning as actual value transmitter 21 and fed into a differencing element 22. This unit determines the difference between actual and desired values $I_Z$–$S_Z$, and feeds these data into a controller 23. This controller forms a correcting signal $G_{BV}$ to be used for the LP-by-pass regulating valve 17, transmitting it to a transducer 24 which converts the signal $G_{BV}$ into a correcting value suitable for the adjustment of the LP-by-pass regulating valve 17.

The desired value generating device 25–30 comprises a transfer unit 25 which can be connected to a $S_{min}$-generator 26 as well as to a $S_{P1}$-function generator 27. The transfer unit 25 is moved in accordance with the "open" or "closed" position of the generator switch (not illustrated) by an actuating device 28 from a first position to a second position or vice versa thusly that the output signal of the transfer unit 25, forming an intermediate desired pressure value S', becomes equal to the signal of the $S_{min}$-generator 26 when the generator switch is open and, when the generator switch is closed, becomes equal to the signal $S_{P1}$ of the $S_{P1}$-function generator 27, the latter delivering a maximum permissible desired pressure value $S_{P1}$ in functional relation to the instantaneously existing quantity of working medium, and thus of the instant power output P. The transfer unit 25 is followed by a largest value selector 29 which receives the intermediate desired pressure value S' as well as a constant desired pressure value $S_{P2}$, delivered by an $S_{P2}$-generator 30, the latter value based on a maximum permissible HP-exhaust steam temperature which must not be exceeded. The largest value selector 29 selects from these desired pressure values S' and $S_{P2}$ the greater, as the effective desired pressure value $S_Z$ = Max (S', $S_{P2}$) and feeds this value into the differencing element 22 discussed above. The desired pressure value $S_{P1}$, formed by the $S_{P1}$-function generator 27, is proportional to the RH-pressure $p_{RH}$ but is somewhat greater than the corresponding RH-pressure $p_{RH}$, for any instantaneous value of the turbine power output P. As a result of this specific control arrangement the LP-by-pass regulating valve 17 closes when the load increases, and opens only if the RH-pressure, assigned to the corresponding load, exceeds a predetermined value.

The value set at the $S_{min}$-generator 26 is normally zero. Since when starting the turbine the wheel chamber pressure will rise and drop a few times for short periods of time (accelerating the turbine), and since during this stage the desired value $S_{P1}$ formed by the $S_{P1}$-function generator 27 will also rise above the value $S_{P2}$ causing the oscillation of the value $S_{P2}$, the desired value $P_{P1}$ is fed into the largest value selector 29 only when the generator switch is closed, utilizing the above mentioned criterion of the generator switch position. (If the generator switch is open, $S_{min}$ reaches the largest value selector 29).

Figure 2:
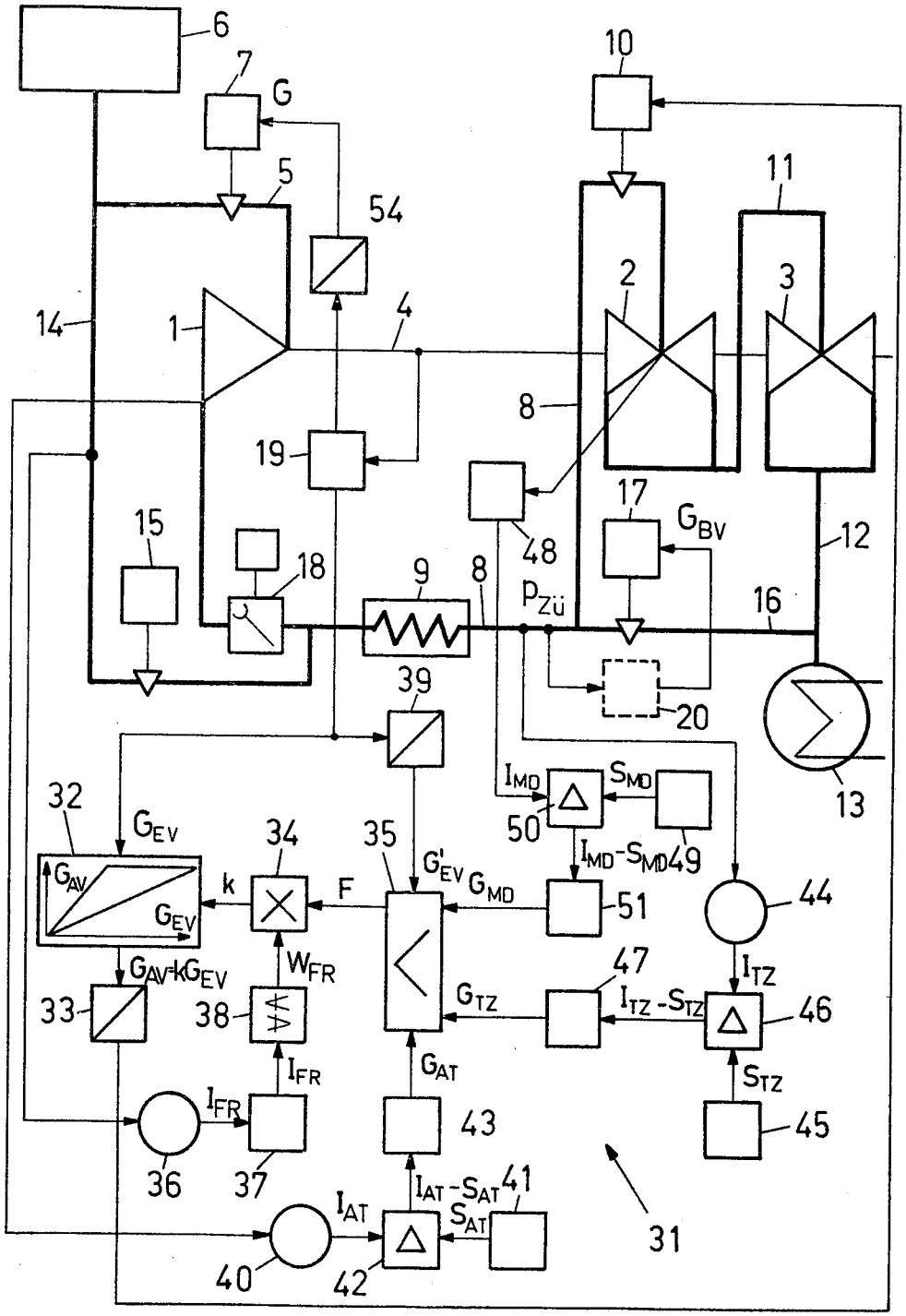
FIG. 2 is similar to FIG. 1, but shows a preferred species of the second feedback control device in detail.
Figure 3:
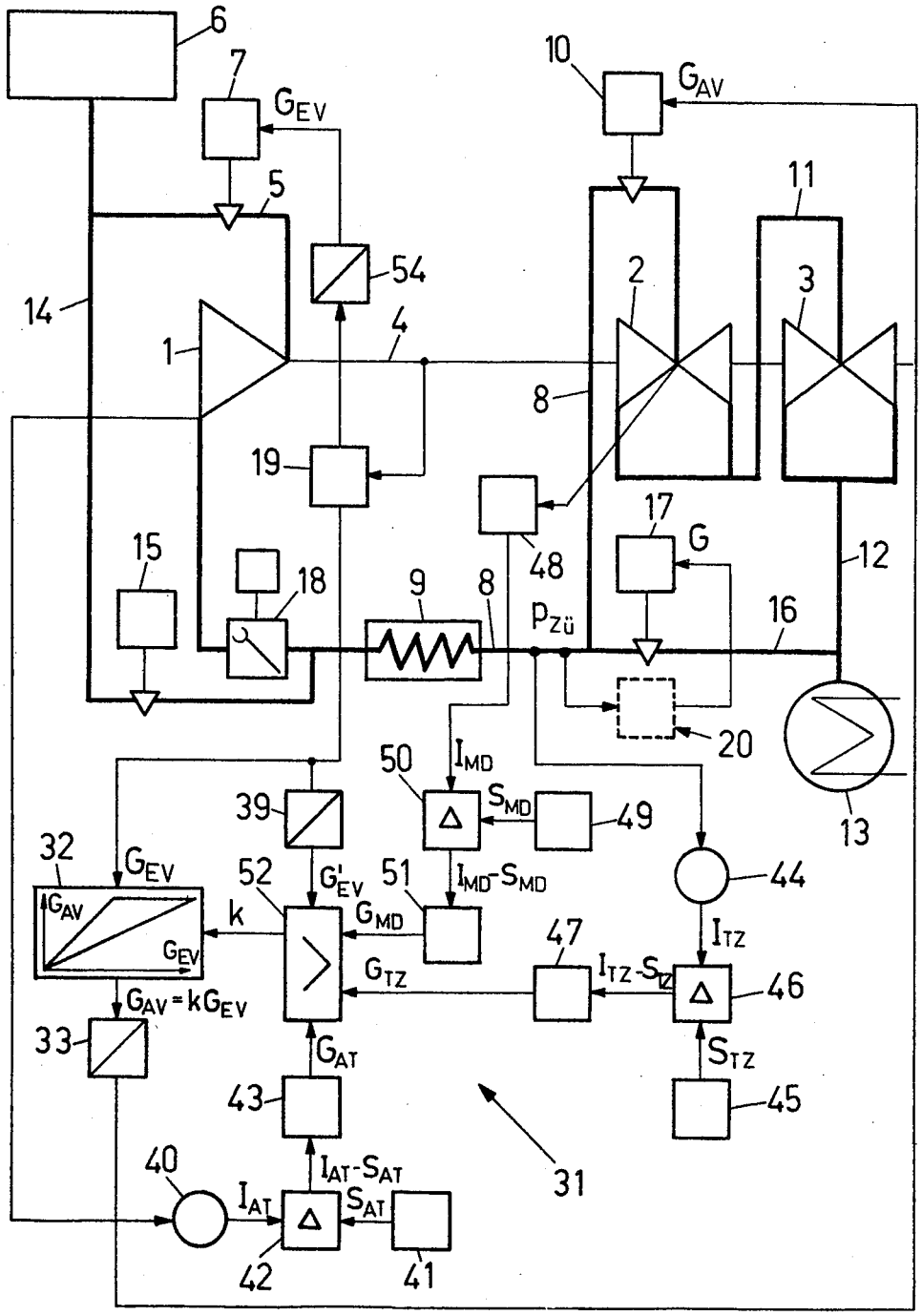
FIGS. 3 and 4 are similar to FIG. 1, but illustrate additional species of the second feedback control device.
Figure 4:
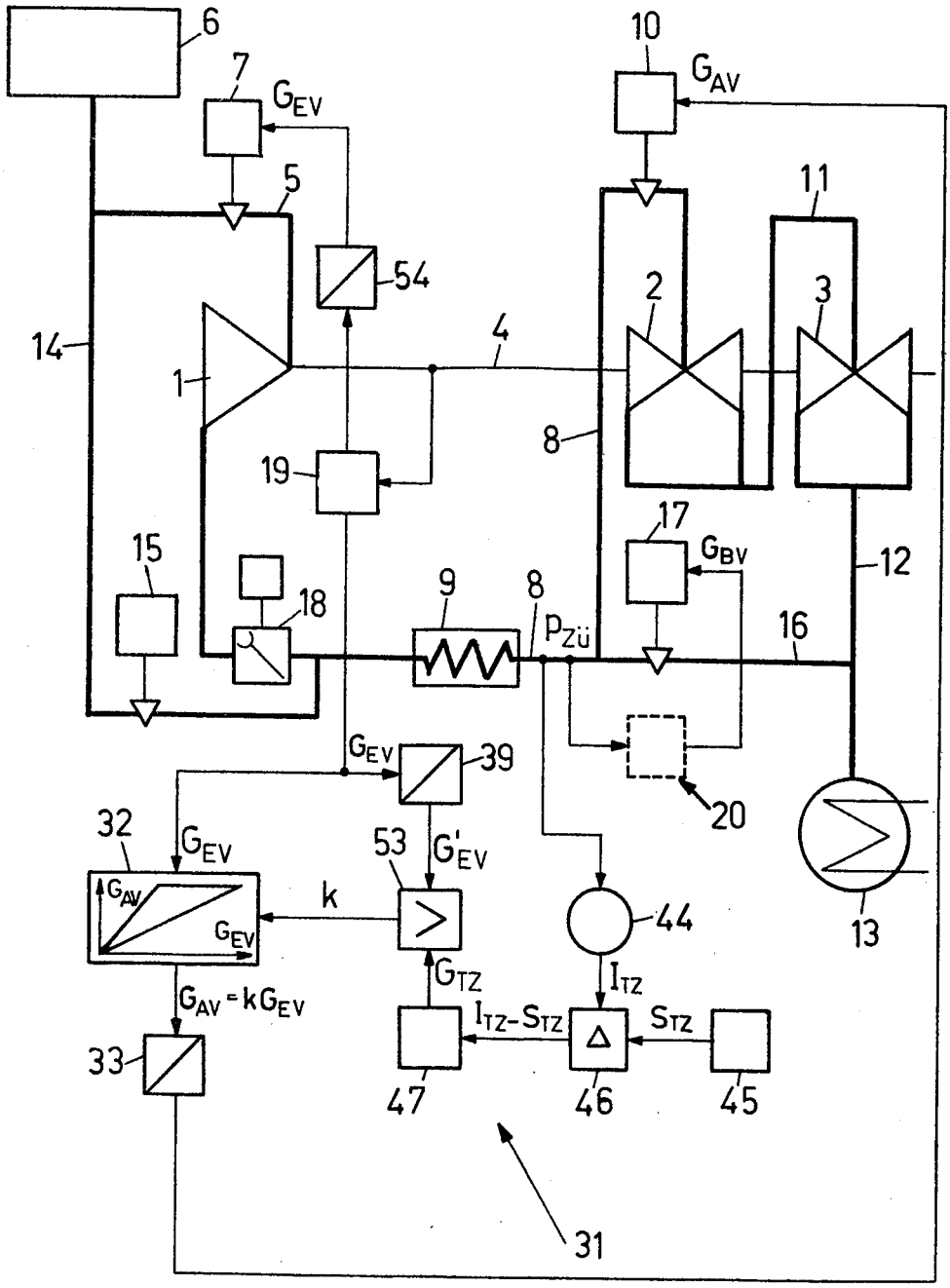

In FIGS. 2, 3 and 4 the first feedback control device 20 is only depicted by a square denoted by numeral 20, but this device can obviously have the configuration shown in FIG. 1 in case of all other species illustrated. However, the device is not limited to the configuration shown, but can be varied in a suitable manner.

In order to regulate the RH-pressure $p_{RH}$ while the LP-by-pass regulating valve 17 is closed by means of the second feedback control device 31 with the intercept valves 10 acting as positioning elements, there is formed the correcting value ("Stellgroesse") $G_{AV}$ for the intercept valves 10 from the correcting value $G_{EV}$ for the inlet valve 7 by multiplying the latter value with a multiplier k, i.e., $G_{AV} = k \cdot G_{EV}$. In order to form this multiplier k, there are being utilized in case of all species a correcting value $G'_{EV}$, which takes into consideration the turbine speed or power output, and a correcting value $G_{TZ}$ which takes into consideration the existing RH-pressure $p_{RH}$. However, it is also possible to utilize other special purpose parameters.

In case of all species discussed below, the multiplication of the correcting value $G_{AV}$ with the multiplier k is accomplished by means of a multiplier relay 32 which forms the correcting value $G_{AV} = k \cdot G_{EV}$ and feeds it into the transducer 33 which converts this value into a correcting value suitable for the adjustment of the intercept valve 10.

Common to all various species is a device, connected to the multiplier relay 32, to form the multiplier k, which will be referred to as k-device. The various species of the second feedback control device, illustrated in FIGS. 2, 3 and 4, differ in the design of the k-device and the nature of the correcting values fed into the device, or in the type of devices connected to it and providing the correcting values required. The k-device shown in FIG. 2 contains a multiplier element 34 connected to the multiplier relay 32 and a smallest value selector 35 connected to the element 34. To the latter there is connected, also, a device 36–38, generating a desired value $W_{FR}$ which takes into consideration the live steam pressure. The device 36–38, delivering the desired $W_{FR}$ value, comprises an actual $I_{FR}$-value transmitter 36 which measures the actual live steam pressure value $I_{FR}$, followed by an amplifier 37 and a limiter 38 connected between the multiplier element 34 and the amplifier 37. This limiter 38 delimits the desired value $W_{FR}$ which is designed to take into consideration the live steam pressure, and feeds this value into the multiplier element 34.

The turbine governing device 19 is connected to the smallest value selector 35 by way of the transducer 39, a feedback control device 40–43 regulating the temperature of the HP-exhaust steam, a turbine-RH feedback control device 44–47, taking into consideration the RH-pressure, and a feedback control device 48–51, regulating the maximum permissible thermal stress of the MP-turbine. The specific arrangement of this species makes its possible to control, during the period of time when the by-pass regulating valve is open and therefore regulates the RH-pressure, the temperature of the HP-exhaust steam or the thermal stress of the MP-turbine by way of the second feedback control device 31, with the intercept valves acting as positioning elements.

The turbine governing device 19, which is known per se, regulates the turbine speed or turbine power output and forms the correcting value $G_{EV}$ for the inlet valve 7, and feeds this value through the transducer 39 for forming the correcting value $G'_{EV}$ for transmission to the smallest value selector 35.

The feedback control device 40–43, which regulates the temperature $I_{AT}$ of the HP-Exhaust steam, comprises the actual $I_{AT}$ value transmitter 40 which measures the actual $I_{AT}$ of the HP-exhaust steam temperature, the desired $S_{AT}$-value generator 41 which forms a fixed desired temperature value $S_{AT}$ by taking into consideration the maximum permissible HP-exhaust steam temperature $I_{AT\,max}$, the differencing member 42 which forms the difference $I_{AT}$–$S_{AT}$, and a controller 43 to form the correcting value $G_{AT}$.

The turbine-RH-feedback control device 44–77 comprises an actual $I_{TZ}$-value transmitter 44 which forms the actual pressure value $I_{TZ}$ of the reheater, a desired $S_{TZ}$-pressure value generator 45 forming a fixed desired pressure value $S_{TZ}$, a differencing element 46, forming the difference $I_{TZ}$–$S_{TZ}$, and a controller 47 to form the correcting value $G_{TZ}$. In case of the species shown in FIG. 2 the desired pressure value $S_{TZ}$ is smaller than the desired pressure value $S_{P2}$, formed by the $S_{P2}$-generator 30 of the first feedback control device 20.

The feedback control device 48–51, which regulates the thermal stress of the MP-turbine, comprises an actual $I_{MD}$-value transmitter 48, which can for example be in the form of a temperature probe, to establish the actual difference-of-temperature value $I_{MD}$ between one hot and one cold point of the MP-rotor (not shown), a desired $S_{MD}$-value generator 49 which forms a maximum permissible fixed desired difference-of-temperature value $S_{MD}$, a differencing member 50 to form the difference $I_{MD}$–$S_{MD}$ and a controller 51 to form the correcting value $G_{MD}$.

The smallest value selector 35 selects the smallest value from the correcting values $G'_{EV}$, $G_{AT}$, $G_{TZ}$ and $G_{MD}$ received by it, and feeds this value as effective corrective value F, — into the multiplier element 34 which forms the multiplier k by multiplying the value F with the correcting value $W_{FR}$.

This species insures the required non-uniform quantitative distribution of the steam through the HP- and the MP/LP-turbine. The RH-pressure $p_{RH}$ is regulated in such manner that the value $G_{AT}$ will become minimal by means of the feedback control device 40–43 if the HP-exhaust steam temperature $I_{AT}$ rises above the permissible value $I_{AT\,max}$, this value $G_{AT}$ finally reaching the multiplier relay 32 by way of the multiplier k and reducing the correcting value $G_{AV}$ since k also becomes a minimum value, thus causing a reduction in the stroke of the intercept valves 10. The governing device 19 adjusts the position of the inlet valves 7 in order to maintain the preset desired value, and the feedback control device 20 consequently adjusts the position of the LP-by-pass regulating valve 17. The thermal stress of the MP-rotor is also monitored. If this stress becomes excessive, the multiplier k becomes a minimum value again, by way of the feedback control device 48–51, and the quantity of steam entering the MP-turbine 2 is again reduced accordingly. The feedback control device 20 will accomplish the adjustments in the manner described above. If the LP-by-pass system is inactive, and if the RH-pressure $p_{RH}$ falls below a predetermined value, the multiplier k is influenced by means of the feedback control device 44–47 in such manner that the RH-pressure $p_{RH}$ is maintained by way of the intercept valves 10 acting as positioning elements. Furthermore, the multiplier k is influenced within certain limits in dependence of the live steam pressure.

The k-device shown in FIG. 3 is provided with a largest value selector 52 which is connected to the multiplier relay 32. This element receives the correcting values $G'_{EV}$, $G_{AT}$, $G_{TZ}$ and $G_{MD}$ which are formed by the appropriate feedback control devices, selects the largest value, and feeds this value into the multiplier relay 32 to serve as multiplier k. The desired pressure value $S_{TZ}$, supplied by the $S_{TZ}$-generator 45, is in case of this species again smaller than the desired pressure value $S_{P2}$ formed by the $S_{P2}$-generator 30 of the first feedback control device 20.

Here again, the required non-uniform quantitative distribution of the steam is insured, and the RH-pressure $p_{RH}$ is regulated in a manner similar to the arrangement shown in FIG. 2. However, the live steam pressure is not being considered here, and it will not influence the multiplier k.

The k-device shown in FIG. 4 is provided with a largest value selector 53 which is connected to the multiplier relay 32. This element receives the correcting values $G'_{EV}$ and $G_{TZ}$ which are formed by the appropriate, above described, feedback control devices; it selects the larger of the two values, and feeds the selected value into the multiplier relay 32 to serve as multiplier k. It is to be noted that in this case the desired pressure value $S_{TZ}$, supplied by the $S_{TZ}$-generator 45, is greater than the desired pressure value $S_{P2}$, formed by the $S_{P2}$-generator 30 of the first feedback control device 20. This species offers a simple solution of the problem. Due to the fact that the desired RH pressure value $S_{TZ}$ is slightly greater than $S_{P2}$, the stroke of the intercept valves 10 will be small during no-load and low-load operation, meaning that the multiplicator k has the maximum value, resulting in the least steep characteristic at the multiplier relay 32. On the other hand, there is no control of the HP-exhaust steam temperature nor of the thermal stress of the MP-turbine 2, and this arrangement therefore will not allow an optimum utilization of the maximum permissible HP-exhaust steam temperature and of the maximum permissible thermal stress of the MP-turbine, but it does accomplish the required non-uniform quantitative distribution of the steam.

Figure 5:
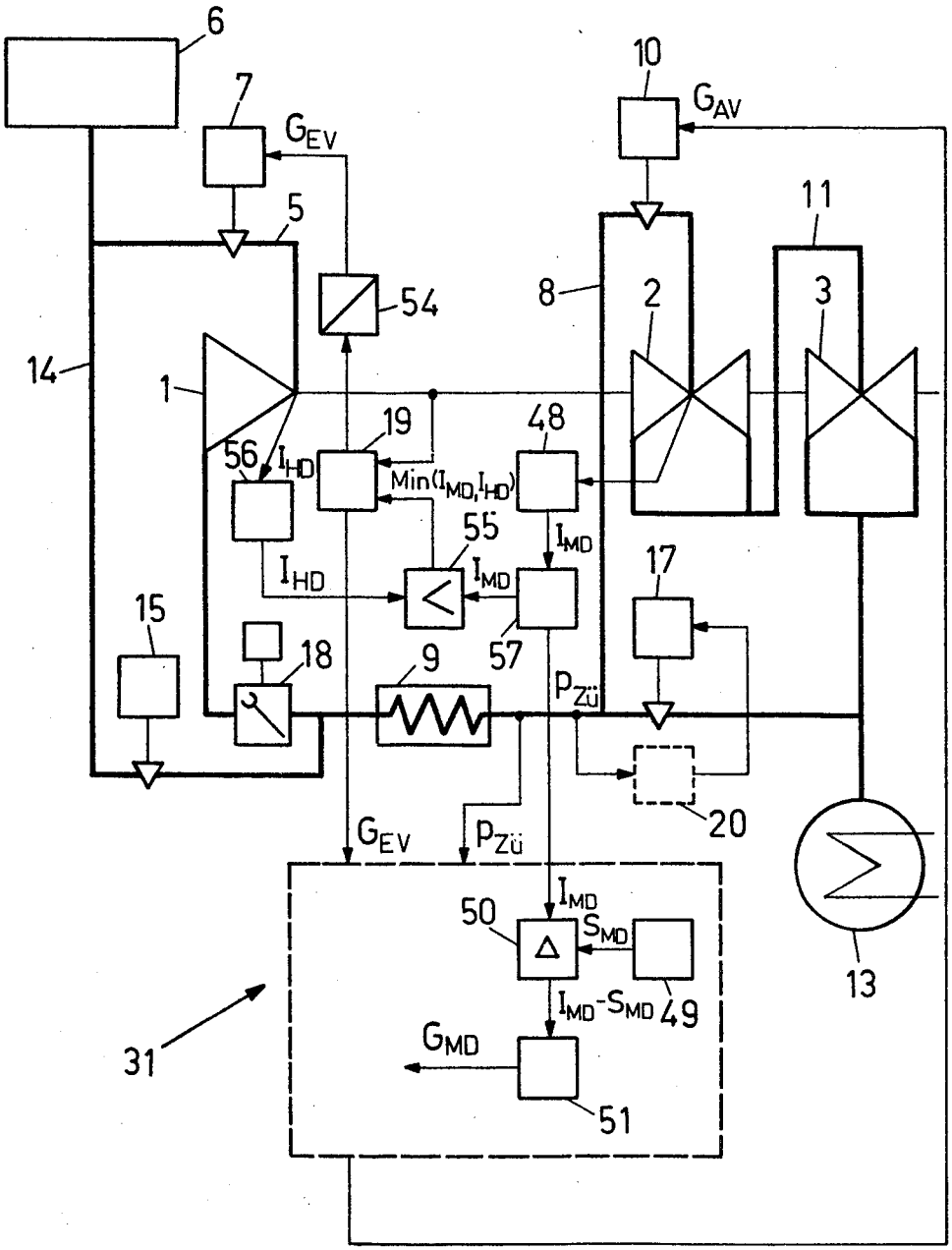
FIG. 5 illustrates an additional device for monitoring the thermal stress of the HP- as well as of the MP-turbine.

FIG. 5 illustrates a species where there is connected to the governing device 19 a smallest value selector 55, and to the element 55 an actual $I_{HD}$-value transmitter 56 which can have the form of an HP-temperature probe. This $I_{HD}$-value transmitter 56 establishes the actual difference-in-temperature value $I_{HD}$, which is found within the HP-rotor (not illustrated) between one hot and one cold point, and transmits this value to the differencing element 55. To this differencing element there is connected a transfer unit 57 which is placed between the above-described actual $I_{MD}$-value transmitter 48 and the differencing element 50 which is part of the feedback control device 48–51, regulating the thermal stress of the HP-turbine 2. Under normal conditions, that is if the HP-by-pass regulating valve 15 is closed, the transfer unit 57 is set thusly that the smallest value selector 55 will receive the signal $I_{MD}$. The smallest value selector 55 selects the smaller value from $I_{MD}$ and $I_{HD}$ and transmits the value to the turbine governing device 19 which is thereby influenced, when forming the correcting value $G_{EV}$ for the inlet valve 7, by the actual thermal stress of the HP- or of the MP-turbine. IF the HP-by-pass regulating valve 15 is open, the transfer unit 57 is set so that the connection to the smallest value selector 55 is broken and that the $I_{MD}$-signal is fed by way of the differencing element 50 into the feedback control device 48–51, so that the instantaneous thermal stress of the MP-turbine 2 will influence the correcting value $G_{MD}$ and consequently the multiplicator k. The $I_{HD}$-signal will still be transmitted to the smallest value selector 55 and influence the turbine-governing device 19, or the correcting value $G_{EV}$ respectively. The apparatus makes it possible to accelerate the HP- and the MP-turbine at the same time and close to the allowable limits of their thermal stresses, since these stresses are monitored continuously to prevent them from increasing beyond their allowable values. This arrangement can be used in conjunction with the species shown by FIGS. 2 and 3.

Finally, it should be noted that the transducers 54, 24 and 33, placed in series with the positioning elements 7, 17 and 10, are required only if the correcting values, formed by the respective controllers, vary in kind from the correcting values needed for the adjustment of the positioning elements. If, for example, the controllers transmit electric signals and the positioning elements are hydraulically operated valves, it will be necessary to convert the electric correcting signals into hydraulic correcting values, and it will then become necessary to place transducers in front of the positioning elements.

I claim:

1. Feedback control method for controlling the starting of a steam turbine unit having a high pressure (HP) turbine, a reheater, an intermediate/low pressure (MP/LP) turbine and conduit means fluidly connecting said turbines and reheater, having at least one inlet valve to admit steam to the HP-turbine and at least one intercept valve to admit steam to the MP/LP-turbine, having a HP-bypass system passing the HP-turbine and comprising at least one regulating valve disposed therein, having a LP-bypass system passing the MP/LP-turbine and comprising at least one regulating valve disposed therein, and having a governing device to regulate the turbine speed or power output, according to which method during no-load and low-load operation and up to a specifically predetermined partial load the pressure within the reheater is regulated by the LP-bypass regulating valve functioning to conduct steam through the LP-bypass in such manner that a greater quantity of steam flows through the HP-turbine than through the MP-turbine, and a smaller quantity of steam flows through the HP-bypass system than through the LP-bypass system, whereby a maximum permissible HP-exhaust steam temperature will not be exceeded and, when the partial load is greater than specified, the pressure within the reheater is regulated by the intercept valve functioning to conduct steam flow to the MP/LP-turbine until the at least one intercept valve is fully open, while the LP-bypass regulating valve is closed during this part of the operation.

2. Method as defined in claim 1, characterized in that for controlling the reheater pressure RH by way of the LP-by-pass regulating valve acting to conduct steam through the LP-bypass, there is utilized a measured value of said pressure in the form of actual pressure value $I_Z$; that there is selected from two desired pressure values S' and $S_{P2}$ the larger value to serve as effective desired pressure value $S_Z$, where $S_{P2}$ represents a desired pressure value that takes into consideration the maximum permissible temperature of the HP-exhaust steam and S' is an intermediate desired pressure value which, during the starting-up operation, has a minimum value $S_{min}$ and which, upon the connection of the generator to the power network, is a desired maximum permissible pressure value $S_{P1}$, functionally related to the instantaneously present power output P; that there is further determined a difference $I_Z$–$S_Z$; and that there is formed therefrom a correcting value $G_{BV}$ for the LP-by-pass regulating valve.

3. Method as defined in claim 2, wherein the desired pressure value $S_{P1}$ is proportional to the RH-pressure $p_{RH}$, and exceeds the instantaneous value of said pressure by a certain amount at any instantaneous value of the turbine power output P.

4. Method as defined in claim 1, characterized in that, for controlling the RH-pressure $p_{RH}$ by way of the at least one intercept valve acting to conduct steam to the MP/LP-turbine, there is formed a correcting value $G_{AV}$ for the at least one intercept valve from a correcting value $G_{EV}$ for the at least one inlet valve by multiplying the latter value by a multiplicator k; that for forming the multiplicator k there are utilized the correcting values $G'_{EV}$ and $G_{EV}$; that the correcting value $G'_{EV}$, formed from the correcting value $G_{EV}$, takes into account the turbine speed or power output and is formed by a turbine governing device by way of a transducer; that a correcting value $G_{TZ}$ takes into account the measured RH-pressure $p_{RH}$ and is formed by a turbine RH-pressure feedback control device as a function of a measured actual RH-pressure value $I_{TZ}$ minus a constant desired pressure value $S_{TZ}$.

5. Method as defined in claim 4 characterized in that a value $S_{P2}$ is determined which represents a desired pressure value which takes into consideration the maximum permissible temperature of the HP-exhaust steam, the desired pressure value $S_{TZ}$ is selected to be smaller than the desired pressure value $S_{P2}$.

6. Method as defined in claim 4, wherein there is selected as the multiplicator k the greater value among $G'_{EV}$ and $G_{TZ}$.

7. Method as defined in claim 4 characterized in that a value $S_{P2}$ is determined which represents a desired pressure value which takes into consideration the maximum permissible temperature of the HP-exhaust steam, the desired pressure value $S_{TZ}$ is greater than the desired pressure value $S_{P2}$.

8. Method as defined in claim 4, characterized in that for forming the multiplicator k there are utilized correcting values $G_{AT}$ and $G_{MD}$; that the correcting value $G_{AT}$ takes into account a temperature $I_{AT}$ of the HP-exhaust steam and is formed by a feedback control device designed to regulate said temperature; and that the correcting value $G_{MD}$ takes into account the thermal stress of the MP-turbine and is formed by a feedback control device designed to regulate said thermal stress.

9. Method as defined in claim 8, characterized in that the actual value $I_{AT}$ of the HP-exhaust steam temperature is measured; that there is formed a constant desired temperature value $S_{AT}$ which takes into account a maximum permissible HP-exhaust steam temperature $I_{AT\text{-}max}$; and there is established a difference $I_{AT}$–$S_{AT}$, the correcting value $G_{AT}$ being of function of said difference.

10. Method as defined in claim 9 according to which there is selected as the multiplicator k the greatest value among $G'_{EV}$, $G_{MD}$, $G_{TZ}$ and $G_{AT}$.

11. Method as defined in claim 8, characterized in that there is formed an actual value $I_{MD}$ representing the difference in temperature between one hot and one cold point of the MP-rotor; that there is formed a desired temperature difference value $S_{MD}$ a maximum permissible difference $I_{MD}$–$S_{MD}$ is established, the correcting value $G_{MD}$ being formed from such difference.

12. Method as defined in claim 11, characterized in that a value $I_{HD}$ is formed, representing an actual difference in temperature between one hot and one cold spot of the HP-rotor; that, if the HP-by-pass regulating valve is closed, there is determined the smaller of the values $I_{HD}$ and $I_{MD}$ and utilized for forming the correcting value $G_{EV}$ for the inlet valve, and that, if the HP-by-pass regulating valve is open, the $I_{HD}$-value signal is utilized for forming the correcting value $G_{EV}$ and $I_{MD}$-value signal is utilized for establishing a difference $I_{MD}$–$S_{MD}$, the possibility being thus given to accelerate and load the HP-turbine and the MP-turbine simultaneously at maximum permissible thermal loads.

13. Method as defined in claim 8 according to which there is selected as an effective desired value F the smallest value among $G'_{EV}$, $G_{MD}$, $G_{TZ}$ and $G_{AT}$, which is multiplied by a value $W_{FR}$ which is a function of the live steam pressure, thereby forming the multiplicator k.

14. Method as defined in claim 13, characterized in that an actual value $I_{FR}$ of the live steam pressure is measured; that the signal $I_{FR}$ is amplified and subsequently limited; and that the value $W_{FR}$ is formed therefrom.

15. Feedback control system for controlling the starting of a steam turbine unit having a high pressure (HP) turbine, a reheater, an intermediate/low pressure (MP/LP) turbine and conduit means fluidly connecting said turbines and reheater, having at least one inlet valve to admit steam to the HP-turbine and at least one intercept valve to admit steam to the MP/LP turbine, having a HP-bypass system passing the HP-turbine and comprising at least one regulating valve disposed therein, having a LP-bypass system passing the MP/LP-turbine and comprising at least one regulating valve disposed therein, and having a governing device to regulate the turbine speed or power output, characterized by a first governing device which is active during no-load and low-load operations up to a predetermined partial load for the purpose of regulating the reheater pressure $P_{AS}$ with the LP-bypass regulating valve functioning to conduct steam through the LP-bypass; and by a second governing device which operates substantially independently from the first device if the partial load is greater than specified above, for the purpose of regulating said pressure, while the LP-bypass regulating valve is closed, with the at least one intercept valve functioning vane to conduct steam to the MP/LP-turbine.

16. Apparatus as defined in claim 15, characterized in that said first governing device comprises an actual $I_Z$-value transmitter for supplying an actual RH-pressure value $I_Z$; means for generating an effective desired pressure value $S_Z$; a differencing element establishing a difference $I_Z$–$S_Z$; and a controller forming from such difference a correcting value $G_{BV}$ for the LP-by-pass regulating valve.

17. Apparatus as defined in claim 16, characterized in that there is provided a $S_{P2}$-generator forming a desired pressure value $S_{P2}$ which takes into account a maximum permissible HP-exhaust steam temperature, a transfer unit forming an intermediate desired pressure value S' in dependence of the "open" or "closed" position of the generator switch, and a largest value selector, following the $S_{P2}$-generator and the transfer unit and forming an effective desired pressure value $S_Z = \text{Max}\ (S_{P2}, S')$.

18. Apparatus as defined in claim 17, characterized in that the pressure value signal S' of the transfer unit is so formed that if the generator switch is open, it is equal to the signal of a $S_{min}$-generator forming a minimum desired pressure value $S_{min}$ and, if the generator switch is closed, is equal to the signal of a $S_{P1}$-function generator which forms a maximum permissible desired pressure value S in functional relation to an instantaneously existing quantity of working medium and of the instantaneous power output, and in that there is provided an actuating device ensuring execution of the necessary switch-over.

19. Apparatus as defined in claim 15, characterized in means forming a correcting value $G_{EV}$ for the inlet valve, the second governing device comprises a multiplier relay forming a correcting value $G_{AV}$ for the at least one intercept valve by multiplying the correcting value $G_{EV}$ for the inlet valve by a multiplier k, and a device to form this multiplier k.

20. Apparatus as defined in claim 19, according to which the device for forming the multiplier k comprises a largest value selector which is connected to the multiplier relay, and there are connected to said largest value selector a turbine governing device by way of a transducer and a turbine RH-feedback control device.

21. Apparatus as defined in claim 20, further characterized in that there are connected to the largest value selector a feedback control device regulating the temperature of the HP-exhaust steam, and a feedback control device regulating the thermal stress of the MP-turbine.

22. Apparatus as defined in claim 19, wherein the device for forming the multiplier k comprises a multiplier element connected to the multiplier relay and a smallest value selector connected to element and wherein to the latter there is connected a $W_{FR}$-generating device generating a desired value $W_{FR}$, which takes into account an actual live steam pressure value $I_{FR}$.

23. Apparatus as defined in claim 22, according to which said $W_{FR}$-generating device comprises an actual $I_{FR}$-value transmitter which measures an actual live steam pressure value $I_{FR}$, an amplifier following a transmitter, and a limiter connected between the amplifier and the multiplier element.

24. Apparatus as defined in claim 22, according to which there are connected to the smallest value selector element a turbine governing device by way of a transducer, a turbine RH-feedback control device, a feedback control device regulating the temperature of HP-exhaust steam, and a feedback control device regulating the thermal stress of the MP-turbine.

25. Apparatus as defined in claim 24, wherein the turbine RH-feedback control device comprises an actual $I_{TZ}$-value transmitter forming an actual RH-pressure value $I_{TZ}$, a desired $S_{TZ}$-pressure value generator forming a fixed desired pressure value $S_{TZ}$, a differencing element forming a difference $I_{TZ}$–$S_{TZ}$, and a controller forming a correcting value $G_{TZ}$.

26. Apparatus as defined in claim 24, wherein the device for forming the multiplier k comprises a largest value selector which is connected to the multiplier relay, and there are connected to said largest value selector a turbine governing device by way of a transducer and a turbine RH-feedback control device, there are connected to the largest value selector a feedback control device regulating the temperature of the HP-exhaust steam, and a feedback control device regulating the thermal stress of the MP-turbine, the feedback control device for the HP-exhaust steam temperature comprises an actual $I_{AT}$-value transmitter which measures an actual value $I_{AT}$ of the HP-exhaust steam temperature; a desired $S_{AT}$-value generator forming a fixed desired temperature value $S_{AT}$ which takes into account a maximum permissible HP-exhaust steam temperature; a differencing element forming a difference $I_{AT}$–$S_{AT}$, and a controller forming a correcting value $G_{AT}$ from such difference.

27. Apparatus as defined in claim 24, wherein the device for forming the multiplier k comprises a largest value selector which is connected to the multiplier relay, and there are connected to said largest value selector a turbine governing device by way of a transducer and a turbine RH-feedback control device, there are connected to the largest value selector a feedback control device regulating the temperature of the HP-exhaust steam, and a feedback control device regulating the thermal stress of the MP-turbine, the feedback control device regulating the thermal stress of the MP-turbine comprises an actual $I_{MD}$-value transmitter forming an actual value $I_{MD}$ representing a difference in temperature existing between one hot and one cold point within the MP-rotor; a desired $S_{MD}$-value generator forming a desired value $S_{MD}$ representing a maximum permissible fixed difference in temperature between said points; a differencing element forming a difference $I_{MD}$–$S_{MD}$; and a controller forming a correcting value $G_{MD}$ from such difference.

28. Apparatus as defined in claim 24 further comprising the device for forming the multiplier k comprises a largest value selector which is connected to the multiplier relay, and there are connected to said largest value selector a turbine governing device by way of a transducer and a turbine RH-feedback control device, there are connected to the largest value selector a feedback control device regulating the temperature of the HP-exhaust steam, and a feedback control device regulating the thermal stress of the MP-turbine, a smallest value selector connected to the turbine governing device; an actual $I_{HD}$-value transmitter connected to said smallest value selector and which forms an actual value $I_{HD}$ representing a difference in temperature existing between one hot and one cold point within the HP-rotor; a transfer unit which is connected to the smallest value selector and which is inserted between an actual $I_{MD}$-value transmitter and a differencing element that is a component of the feedback control device regulating the thermal stress of the MP-turbine, a signal $I_{MD}$ of the actual $I_{MD}$-value transmitter reaching the smallest value selector if the transfer unit is in its first switching position and reaching said differencing element if said switch is in its second position.

* * * * *